US006364783B1

(12) United States Patent
Kellogg, Jr. et al.

(10) Patent No.: US 6,364,783 B1
(45) Date of Patent: Apr. 2, 2002

(54) PRACTICE POOL AND BILLIARD AIMING SYSTEM AND METHOD OF USE

(76) Inventors: Jack V. Kellogg, Jr.; Dana M. Kellogg, both of 106 Van Buren Ave., Cuyahoga Falls, OH (US) 44221

( * ) Notice: Subject to any disclaimer, the term of this patent is extended or adjusted under 35 U.S.C. 154(b) by 0 days.

(21) Appl. No.: 09/498,846

(22) Filed: Feb. 7, 2000

Related U.S. Application Data

(63) Continuation-in-part of application No. 09/258,933, filed on Mar. 1, 1999.

(51) Int. Cl.[7] ..... A63D 15/00
(52) U.S. Cl. ..... 473/2
(58) Field of Search ..... 473/1, 2, 52, 447, 473/250, 253, 254

(56) References Cited

U.S. PATENT DOCUMENTS

| | | | |
|---|---|---|---|
| 513,876 | A | 1/1894 | Burt |
| 666,333 | A | 1/1901 | Stevens |
| 1,108,441 | A | 8/1914 | Hubbell |
| 3,466,038 | A | 9/1969 | Hill |
| 3,504,914 | A | 4/1970 | Bradbury |
| 3,843,120 | A | 10/1974 | Ricci |
| 3,947,026 | A | 3/1976 | Scoutten |
| 3,993,305 | A | 11/1976 | Nicholson |
| 4,116,439 | A | 9/1978 | Chavarria et al. |
| 4,157,805 | A | 6/1979 | Haber et al. |
| 4,182,737 | A | 1/1980 | Haber et al. |
| 4,214,753 | A | 7/1980 | Haber et al. |
| 4,345,759 | A | 8/1982 | Nims |
| 4,526,368 | A | 7/1985 | Furda |
| 4,546,975 | A | 10/1985 | Nims |
| 5,322,475 | A | 6/1994 | Irvin |
| 5,716,283 | A | 2/1998 | Simpson et al. |

*Primary Examiner*—Paul T. Sewell
*Assistant Examiner*—M. Chambers
(74) *Attorney, Agent, or Firm*—Alexander B. Bommarito; Hahn Loeser & Parks LLP

(57) ABSTRACT

The present invention provides a novel cue ball and object ball combination for use with playing pool and pocket billiards, and the method of use of thereof. The invention is useful in teaching and practicing pool and pocket billiards. The object ball has two perpendicular bands which intersect to form a contact point. The cue ball is transparent and also has two perpendicular bands which intersect to create an aiming point. The aiming point of the cue ball is oriented by having one perpendicular band in parallel with the table, and one perpendicular band parallel to the vertical band on the object ball. The participant can sight the aiming point through the transparent cue ball and direct the aiming point to the contact point on the object ball. Accordingly, the aiming point of the cue ball is the only portion of the cue ball to contact the object ball. The impact of the aiming point to the contact point forces the object ball along its intended path.

19 Claims, 4 Drawing Sheets

PRACTICE POOL AND BILLIARD AIMING SYSTEM AND METHOD OF USE

This is a continuation-in-part application of copending U.S. patent application Ser. No. 09/258,933, which was filed on Mar. 1, 1999.

BACKGROUND AND SUMMARY OF THE INVENTION

The present invention pertains generally to new and novel improvements in the field of sports training equipment. More particularly, the present invention relates to training and practice equipment and methods for improving aiming and shooting skills and may be used to determine cueing proficiencies, and while being particularly applicable to the game of pocket billiards, the teachings of the present invention may also be useful in other games requiring accuracy in cueing, such as cushioned billiards.

Standard pocket billiard games are normally played using fifteen (15) consecutively numbered balls and a cueball. At the start of a game, the numbered balls are typically placed in a triangular shaped rack so the numbered balls are positioned in an abutting relationship into a triangular configuration. When retained by the rack, the triangular positioned group of numbers balls are positioned with the leading numbered ball at one of the triangular tips positioned over a marked spot located on one end portion of the billiard table and the rack is removed.

A cueball is then positioned at the opposite end portion of the billiard table at any desired location beyond a second marked spot located at that opposite end portion of the billiard table. The cueball is propelled by a cue in a conventional and well known manner from this opposite end portion of the billiard table to strike the triangular group of numbered balls and move them to various locations, normally somewhat randomly spaced apart around the billiard table. At this point, the game progresses along varied procedures, most, if not all of which, include an object ball being struck by a cueball which is propelled toward the object ball by the force of a cue stick. The goal of the game is generally to sink the object ball into a pocket on the billiard table without sinking the cueball in any pocket on the billiard table.

One of the most misunderstood and difficult aspects of the game of pool is to discern the geometric linear relationship between the cueball and the object ball. It is well know that an object ball will travel along a straight line originating at the point where the cueball contacts the object ball and extending through the center of the object ball. There is also a relationship of physics to the geometry of the game of pool. Accordingly, the game of pool is a game of both physics and geometry. Since the object ball travels in a straight line, players of pockets billiards typically picture an imaginary line from the center of a pocket on the billiard table through the center of the object ball. The termination of this imaginary line establishes a point where the cueball should contact the object ball to propel the object ball into the pocket on the billiard table. This is commonly referred to as the "contact point." It makes no difference where the balls are located on the billiard table, as long as the cueball makes good contact at the "contact point" on the object ball, the object ball will travel along the imaginary line. The cueball, however, in reaching the "contact point" on the object ball does not necessarily travel in a straight line, nor does it have to roll naturally. The cueball may be considered to be rolling naturally when it travels the length of its circumference each revolution of the cueball. The physics of may be applied to the cueball as a result of a given stroke and tip placement with the cue stick. The physics of spin complicates the game of pool and contributes to the complexity of predicting and understanding the effects on the cueball of any given shot.

Aiming the cueball so it strikes the termination point of the imaginary line, which is the contact point of the imaginary line that bisects the object ball and the pocket of choice, is difficult because the shooter cannot easily discern the point of contact on the object ball. It is also difficult for the shooter to discern the point on the cueball commonly referred to as the "aiming point," which should normally be used for both aligning the aim and impacting the contact point, when the shooter is positioned behind the cueball. The "aiming point" located on the front, or the side furthest from the shooter, of the cueball is normally blocked from the shooter's view by the opaqueness of the cueball. The "contact point" of the object ball is also visually difficult to determine because, in part, the depth perception of the roundness of the circumference of the object ball is difficult to determine, and also, in part, because the point on the circumference where the "contact point" of the object ball is in no distinct way indicated, and is difficult to precisely determine. The "contact point" of the object ball can be understood to always be located at a specific point on the particular object ball circumference, which is half the height of the ball up from the billiard table and directly opposite the pocket of choice on the billiard table.

As a result of these difficulties, billiard players have developed various methods of sighting the correct "aiming point" on the cueball and the correct "contact point" on the object ball. One common method of sighting is the method commonly referred to as the "ghost ball" method. This method of sighting the correct "contact point" on the object ball is shown schematically in FIG. 1. Imaginary ball 10 can be used to determine the proper cueball 12 line of aim 14. Imaginary ball 10 is positioned in contact with object ball 16 such that their centers are aligned with intended path 18 of object ball 16. Cueball 12 is then propelled by cue 20 at the center of imaginary ball 10, replacing its position, and striking object ball 16 at "contact point" 22 to propel object ball 16 along intended path 18.

In playing the game of billiards, it is beneficial to understand the actions of the cueball when it is stroked, and the reactions of the cueball and the object ball when impacted due to the calculated collision of a particular shot. As this relates to the complex interaction between the geometry and physics of the game, visual feedback from the balls is particularly important in training a player about the result to expect of any particular shot. The normal markings present on billiard balls, and especially the cueball being entirely white, make it difficult for many players to perceive the actions of the balls, such as spin, or to locate the proper "aiming point" on the cueball, or perceive the horizontal roundness and "contact point" of the object ball.

The foregoing matters relating to the aiming, contacting, perceiving of the roundness and interactions of the cueball and the object ball make it difficult for players of all skill levels to master the game of pool because of the difficulty in determining either the geometric positions of the "aiming point" of the cueball and the "contact point" of the object ball or the related effects of physics on the stroke of the cueball and the consequences of impact with the object ball. A practice system which would provide visual and direct reference of the "aiming point" of the cueball, the "contact point" of the object ball, horizontal roundness of the object ball and the effects of each particular shot would be beneficial to player of all skill levels.

U.S. Pat. No. 3,993,305 to Nicholson, issued Nov. 23, 1976, for a "Pocket Billiard Training Ball and Method of Teaching Sighting When Playing Pocket Billiard" discloses a training object ball which is segmented into twelve (12) legended segments. The ball has no horizontal band perpendicular to the segment boundaries for situating it parallel to the playing surface of the table. There is not a singular point on its surface to indicate a specific point of contact from the cueball and it is not a cueball.

U.S. Pat. No. 5,716,283 to Simpson, et al., issued Feb. 10, 1998, for a "Practice Ball System for Training in the Playing of Pool and Pocket Billiard" discloses a practice ball system including an opaque cueball with a single band circumscribed on the outer surface defining the central meridian. The system includes an object ball which has a first hemisphere having an outer surface of a first color and a second hemisphere having an outer surface of a second color generally contrasting with the first color. The object ball surface extends about an axis of revolution circumscribed by a central meridian. The cueball is not transparent and it does not have a second band circumscribed around a second central meridian to allow the ball to be placed relative to the playing surface while simultaneously relative to the object ball. It is not transparent to allow the shooter to look through the ball and directly see the actual point on the cueball to aim directly at the "contact point" on the object ball. It does not distinctly and separately define the point on the cueball which it to aim at the object ball. The object ball does not have a first band circumscribed around a central meridian allowing the vertical alignment of the ball relatively perpendicular to the pocket on the billiard table while simultaneously relatively parallel to the position of the cueball. It does not have a second band circumscribed around a central meridian to place the object ball relatively horizontal to the playing surface. It does not have a specifically defined point on the object ball to be contacted by the cueball. It does not have indicia to be used to visualize the horizontal roundness of the object ball. It does not reference an "aiming point" on the cueball or a "contact point" on the object ball. It does not present a method to propel the object ball directly to an intended target.

Accordingly, the present invention is directed to a transparent cueball and opaque object ball as they relate to a training system for use in the game of pool and pocket billiards and the method of using the system in practice. They are applied in practice using a method employing the inherent visual data of the system to sight the object ball and directly aim the transparent cueball. The position of the "contact point" on the object ball which is to be contacted and the "aiming point" on the transparent cueball which is to be aimed to contact the object ball and the related motions resulting from the cueball being stroked by a cue tip and impacting the object ball are readily determined when utilizing the preferred embodiment of the present invention disclosed herein because the transparent cueball and the object ball of the system have visual indicators to relate to the player information concerning proper aiming, contacting and motion of the balls. By following a training routine with exercises designed to take advantage of the capabilities of the practice system in accordance with the present invention, players may improve their alignment, aiming and shooting abilities.

Accordingly, an object of the present invention is the provision of a pocket billiard practice ball system and method of aiming in the playing of pool and pocket billiards for training the playing of pool or pocket billiards.

Yet another object of the present invention is the provision of a pocket billiard practice ball system and method of aiming in the playing of pool and pocket billiards which enables a shooter to determine the correct "contact point" on the object ball and an imaginary line from the "contact point" on the object ball through the center of the ball to the pocket on the billiard table which also facilitates the shooter's ability to strike the "contact point" on the object ball.

Still another object of the present invention is the provision of a pocket billiard practice ball system and method of aiming in the playing of pool and pocket billiards which enables a shooter to use the front, or side furthest from the shooter, of a transparent practice cueball to visualize the "aiming point" of the transparent practice cueball and sight a line of aim congruent to the imaginary line of travel from the "aiming point" on the transparent practice cueball directly to the "contact point" of the object ball which facilitates the shooter's ability to strike the "contact point" on the object ball.

These and other objects of the present invention are attained by a pocket billiard practice ball system and method of aiming in the playing of pool and pocket billiards which includes an object ball which is opaque. The surface of the ball is distinguished by two (2) different colored bands, perpendicular to each other, each colored band defining a circumference or central meridian. These colored bands may generally be thought of as being a vertical band and a horizontal band of the present invention of the practice ball system. As generally relates to the two (2) hemispheres about the vertical band, a first hemisphere may have an outer surface of a first color and a second hemisphere of a second, generally contrasting color. The colored bands of the object ball are distinctly separate and different in color from that of either of the hemispheres. The first and second hemispheres meet the same one of the colored bands which defines a circular locus of the central meridian. It is apparent that the horizontal band divides the colored hemispheres into quadrants. The colored bands allow the object ball to be properly positioned relative to a chosen path of travel while simultaneously positioned parallel to the cueball and also provide visual feedback for discerning the accuracy with which the ball follows the path after being impacted.

It is also a feature of the present invention to provide a practice transparent cueball for training in the playing of pool or pocket billiards. The cueball of the system is transparent or clear in nature. The surface of the practice transparent cueball is distinguished by two (2) different colored bands, perpendicular to each other, each defining a circumference or central meridian. These colored bands may be actual bands properly placed within the transparent practice cueball or may be a variation having the same effect, such as two (2) discs placed appropriately within the transparent practice cueball where the edges of the discs present the effect of colored bands. The bands allow the transparent practice cueball to be properly positioned relative to the object ball in establishing the correct "aiming point" on the transparent practice cueball and also provide visual feedback for discerning the effects of spin on the transparent practice cueball after being stroked by a cue stick tip.

It is also a feature of the present invention that the bands on both the transparent practice cueball and the object ball provide visual feedback which allows for the depth perception of the curvature of the transparent practice cueball and the object ball of the system. The awareness of this depth perception to the curvature is beneficial to the shooter because the correct "aiming point" of the transparent practice cueball and the "contact point" of the object ball lie at specific and separate points along the curvatures of the respective balls which determines the required geometric angle at which the transparent practice cueball must approach the object ball for the proper impact and coincidence upon collision of the "aiming point" of the transparent practice cueball and the "contact point" of the object pall to propel the object ball along its intended path.

The pocket billiard practice ball system and method of aiming in the playing of pool and pocket billiards in accordance with the present invention includes the practice balls of the system and the method, elements and arrangement of steps employed in the system and is exemplified in the detailed description of the drawings. Reference to that detailed description of the drawings and to the accompanying drawings should be had for a more complete understanding and appreciation of the nature and objects of the present invention, although other objects may to obvious to those have ordinary skill in the relevant art.

Other advantages and novel features of the present invention will become apparent in the following detailed description of the invention when considered in conjunction with the accompanying drawings.

DETAILED DESCRIPTION OF THE DRAWINGS

Figure 3:
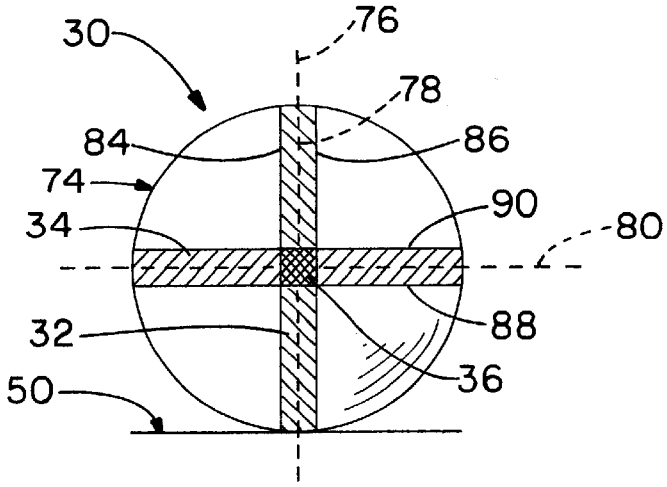
FIG. 3 is a side view of a transparent practice cueball used with the preferred embodiment of a pocket billiard practice ball system and method of aiming in the playing of pool and pocket billiards in accordance with the present invention as shown in FIG. 2.
Figure 4:
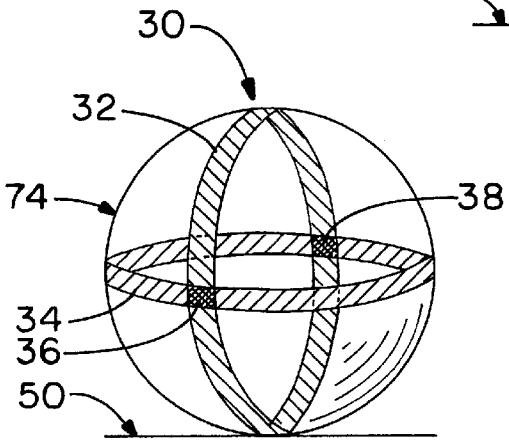
FIG. 4 is a turned side view of the transparent practice cueball shown in FIG. 3 used with the preferred embodiment of a pocket billiard practice ball system and method of aiming in the playing of pool and pocket billiards in accordance with the present invention as shown in FIG. 2.

In the following detailed description of a preferred embodiment of the present invention, reference is made to the accompanying drawings which, in conjunction with this detailed description, illustrate and describe a preferred embodiment of a pocket billiard practice ball system and method of aiming in the playing of pool and pocket billiards in accordance with the present invention. Referring to FIGS. 3 and 4, transparent practice cueball 30 is transparent and circumscribed by two (2) perpendicular bands 32 and 34 about the circumference of transparent practice cueball 30 with intersections 36 and 38 defined and selectively referenced as "aiming points" for transparent practice cueball 30 which, when transparent practice cueball 30 is properly oriented, only one "aiming point" is used.

Figure 5:
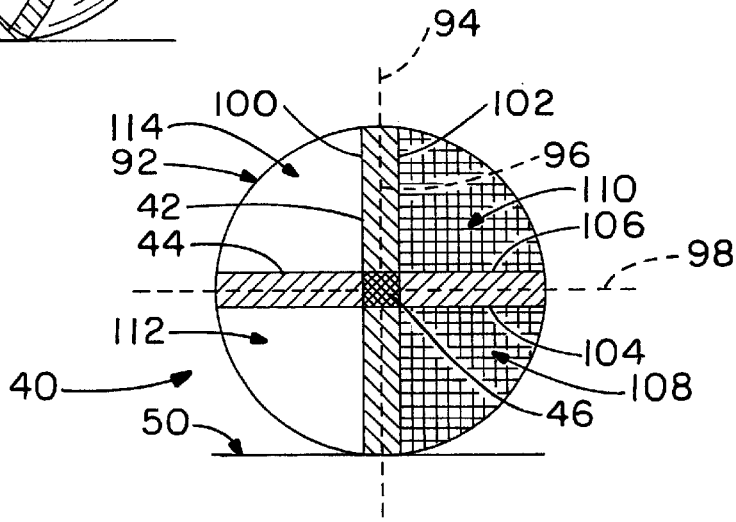
FIG. 5 is a side view of an object ball used with the preferred embodiment of a pocket billiard practice ball system and method of aiming in the playing of pool and pocket billiards in accordance with the present invention as shown in FIG. 2.
Figure 6:
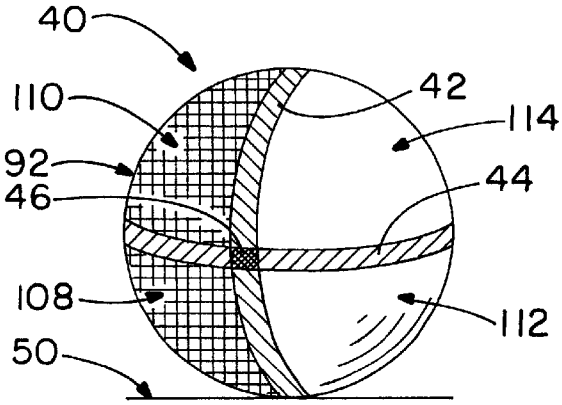
FIG. 6 is a turned side view of the object ball shown in FIG. 5 used with the preferred embodiment of a pocket billiard practice ball system and method of aiming in the playing of pool arid pocket billiards in accordance with the present invention as shown in FIG. 2.

Referring next to FIGS. 5 and 6, object ball 40 is opaque and circumscribed by two (2) perpendicular bands 42 and 44 about the circumference of object ball 40 with intersections 46 and 48 defined and selectively referenced as "contact points" for object ball 40 which, when object ball 40 is properly oriented, only one "contact point" is used. When transparent practice cueball 30 and object ball 40 are properly oriented relative to each other and to billiard table surface 50 one (1) perpendicular band 32 or 34 of transparent practice cueball 30 and one (1) perpendicular band 42 or 44 of object ball 40 will be horizontally parallel to billiard table surface 50 and the other of perpendicular band 32 or 34 of transparent practice cueball 30 and the other of perpendicular band 42 or 44 of object ball 40 will be parallel to each other.

Figure 1:
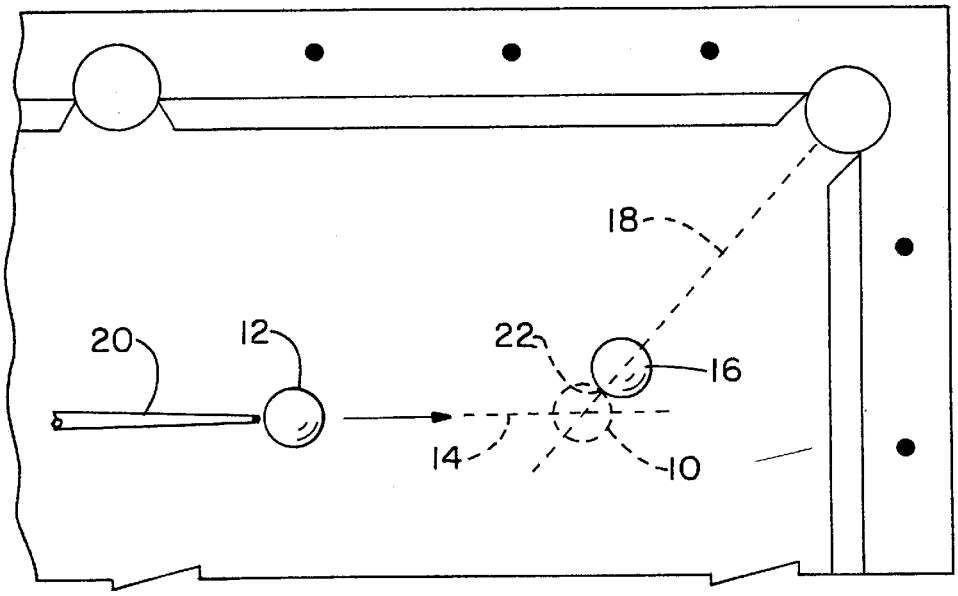
FIG.-1 Prior Art
FIG. 1 is a top view showing a prior art "ghost ball" method of aiming.
Figure 7:
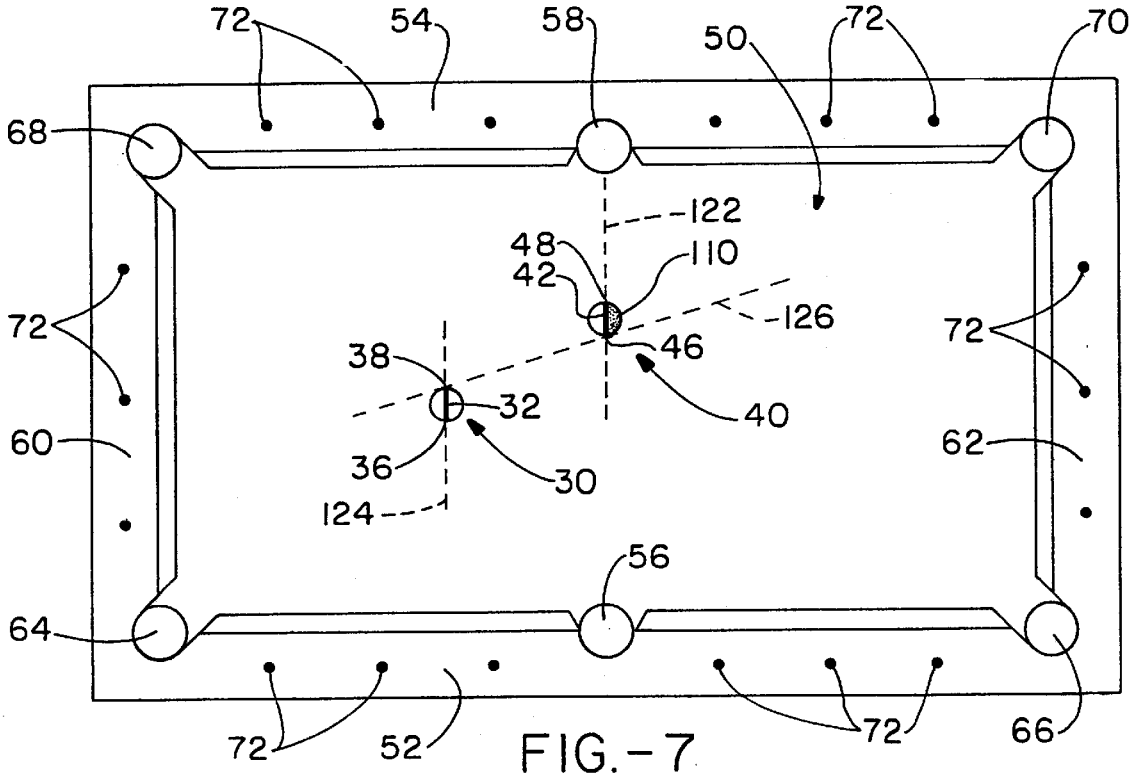
FIG. 7 is a first top view of the preferred embodiment of a pocket billiard practice ball system and method of aiming in the playing of pool and pocket billiards in accordance with the present invention as shown in FIG. 2.
Figure 2:
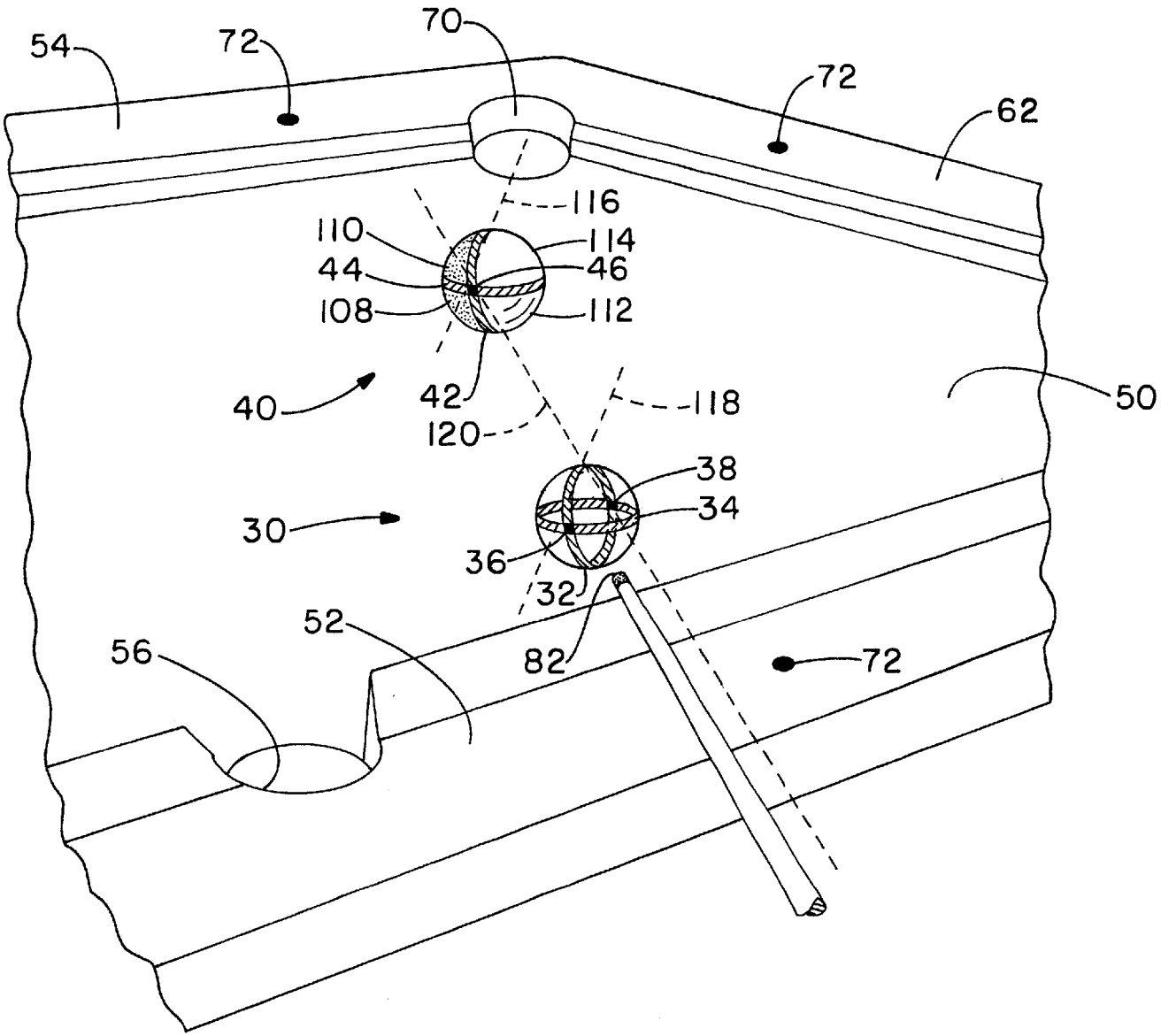
FIG. 2 is a prospective view of the preferred embodiment of a pocket billiard practice ball system and method of aiming in the playing of pool and pocket billiards in accordance with the present invention.

Referring next to FIG. 2, the pocket billiard practice ball system and method of aiming in the playing of pool and pocket billiards in accordance with the present invention includes transparent practice cueball 30 shown aligned for a shot with object ball 40. As will become more apparent from the discussion which follows, the preferred embodiment of transparent practice cueball 30 in accordance with the present invention is transparent to facilitate aiming by the method of direct line of sight. For illustrative purposes, transparent practice cueball 30 and object ball 40 are illustrated as being on a regular pool table, with billiard table surface 50 supporting transparent practice cueball 30 and object ball 40. Referring to FIG. 7, billiard table surface 50 is preferably bounded by a pair of side rails 52 and 54 which includes side pockets 56 and 58 and a pair of end rails 60 and 62 which connect with corner pockets 64, 66, 68 and 70. For purposes of reference, side rails 52 and 54 and end rails 60 and 62 are shown as including circle inlays or sights 72.

Referring again to FIGS. 3 and 4, transparent practice cueball 30 is preferably generally transparent and includes spherical outer surface 74 extending about axis of revolution 76 and circumscribed about a central meridian, represented in phantom by reference number 78. Spherical outer surface 74 of transparent practice cueball includes perpendicular band 32 which defines central meridian 78. Additionally, spherical outer surface 74 of transparent practice cueball 30 includes perpendicular band 34 which defines central meridian 80. In accordance with the present invention, perpendicular bands 32 and 34 of transparent practice cueball 30 are preferably visually perceptible as transparent practice cueball 30 is moving along billiard table surface 50. Thus, the player is supplied with visual information for discerning the effects of spin imparted by cue stick tip 82 on transparent practice cueball 30.

In a preferred embodiment of transparent practice cueball 30, perpendicular band 32 includes first boundary 84 and second boundary 86, which define a section of transparent practice cue ball 30 including central meridian 78. Perpendicular band 32 of transparent practice cueball 30 is, therefore, shown as appearing as a colored band circumscribed about spherical outer surface 74 of transparent practice cueball 30. To enhance its contrast with the transparent absence of color of transparent practice cueball 30, perpendicular band 32 of transparent practice cueball 30 is preferably provided as a green band which may be painted, printed, inlaid or otherwise incorporated into spherical outer surface 74 of transparent practice cueball 30. The width of perpendicular band 32 of transparent practice cueball 30 is preferably approximately 11 millimeters (approximately 0.043 inches). After a stroke on transparent practice cueball 30, the motion of perpendicular band 32 on transparent practice cueball 30 provides visual feedback to the player to discern the effects of spin imparted on transparent practice cueball 30. Another function of perpendicular band 32 on transparent practice cueball 30 is to align transparent practice cueball 30 in the same relative position, coordinated by perpendicular band 42 on object ball 40 in relation to billiard table surface 50 and the intended path of travel for object ball 40.

Transparent practice cueball 30 may additionally include perpendicular band 34. In a preferred embodiment of transparent practice cueball 30, perpendicular band 34 includes first boundary 88 and second boundary 90, which define a section of transparent practice cueball 30 including central meridian 80. Perpendicular band 34 of transparent practice cueball 30 is shown as appearing as a colored band circumscribed about spherical outer surface 74 of transparent practice cueball 30. To enhance its contrast with the transparent absence of color of transparent practice cueball 30, and the preferred color green of perpendicular band 32 of transparent practice cueball 30, perpendicular band 34 of transparent practice cueball 30 is preferably provided as a black band which may be painted, printed, inlaid or otherwise in corporated into spherical outer surface 74 of transparent practice cueball 30. The width of perpendicular band 34 of transparent practice cueball 30 is preferably approximately 11 milimeters (approximately 0.43 inches). After a stroke on transparent practice cueball 30, the motion of perpendicular band 34 on transparent practice cueball 30 provides visual feedback to the player to discern the effects of spin imparted on transparent practice cueball 30. Another function of perpendicular band 34 of transparent practice cueball 30 is in serving to align transparent practice cueball 30 relative to perpendicular band 44 of object ball 40 while simultaneously to billiard table surface 50.

Transparent practice cueball 30 also preferably includes intersections 36 and 38 between perpendicular band 32 and perpendicular band 34. Intersections 36 and 38 of transparent practice cueball 30 define a section of transparent practice cueball 30 defined by the intersections of perpendicular band 32 and perpendicular band 34. To enhance their contrast with the transparent absence of color of transparent practice cueball 30, and the preferred color green of perpendicular band 32 of transparent practice cueball 30 and the preferred color black of perpendicular band 34 of transparent practice cueball 30, intersections 36 and 38 on transparent practice cueball 30 are preferably provided as red and rectangular and may be painted, printed, inlaid or otherwise incorporated into spherical outer surface 74 of transparent practice cueball 30. One function of intersections 36 and 38 on transparent practice cueball 30 is in serving to align the direct line of sight of intersections 36 and 38 of transparent practice cueball 30 relative to intersections 46 and 48 on object ball 40. It therefore will be appreciated that perpendicular bands 32 and 34 and intersections 36 and 38 of transparent practice cueball 30 function synergistically in facilitating shot alignment and in providing visual information as to the effect of spin on transparent practice cueball 30. Transparent practice cueball 30 preferably has a diameter of approximately 2.25 inches and a critical radius of approximately 0.5625 of an inch.

Referring to FIGS. 5 and 6, object ball 40 includes spherical outer surface 92 extending about axis of revolution 94 and circumscribed about a central meridian, represented in phantom by reference number 96. Spherical outer surface 92 of object ball 40 includes perpendicular band 42 which defines central meridian 96. Additionally, spherical outer surface 92 of object ball 40 includes perpendicular band 44 which defines central meridian 98. In accordance with the present invention, perpendicular bands 42 and 44 of object ball 40 are preferably visually perceptible as object ball 40 is moving along billiard table surface 50. Thus, the player is supplied with visual information for discerning the effects of motion imparted by impact of transparent practice cueball 30.

In a preferred embodiment of object ball 40, perpendicular band 42 includes first boundary 100 and second boundary 102, which define a section of object ball 40 including central meridian 96. Perpendicular band 42 of object ball 40 is, therefore, shown as appearing as a colored band circumscribed about spherical outer surface 92 of object ball 40. To enhance its contrast with the preferred white and yellow colors of object ball 40, perpendicular band 42 of object ball 40 is preferably provided as a green band which may be painted, printed, inlaid or otherwise incorporated into spherical outer surface 92 of object ball 40. The width of perpendicular band 42 of object ball 40 is preferably approximately 11 millimeters (approximately 0.043 inches). After impact from transparent practice cueball 40, the motion of perpendicular band 42 on object ball 40 provides visual feedback to the player to discern the effects of impact imparted on object ball 40. Another function of perpendicular band 42 on object ball 40 is to align object ball 40 relative to perpendicular band 32 on transparent practice cueball 30, while simultaneously generally perpendicular as relative to one of side pockets 52 or 54 or corner pockets 64, 66, 68 or 70.

Object ball 40 may additionally include perpendicular band 44. In a preferred embodiment of object ball 40, perpendicular band 44 includes first boundary 104 and second boundary 106, which define a section of object ball 40 including central meridian 98. Perpendicular band 44 of object ball 40 is shown as appearing as a colored band circumscribed about spherical outer surface 92 of object ball 40. To enhance its contrast with the preferred white or yellow color of object ball 40, and the preferred color green of perpendicular band 42 of object ball 40, perpendicular band 44 of object ball 40 is preferably provided as a black band which may be painted, printed, inlaid or otherwise incorporated into spherical outer surface 92 of object ball 40. The width of perpendicular band 44 of object ball 40 is preferably approximately 11 millimeters (approximately 0.43 inches). After an impact by transparent practice cueball 30, the motion of perpendicular band 44 on object ball 40 provides visual feedback to the player to discern the effects of motion imparted by impact from transparent practice cueball 30. Another function of perpendicular band 44 of object ball 40 is in serving to align object ball 40 relative to perpendicular band 34 on transparent practice cueball 30 while simultaneously to billiard table surface 50.

Object ball 40 may be seen to define two (2) quadrants 108 and 110 defined by being bounded on the same side of object ball 40 by perpendicular band 42 on object ball 40 and bisected by perpendicular band 44 on object ball 40. The two (2) quadrants 108 and 110 preferably are provided as being yellow in color. Object ball 40 may also be seen to define two (2) additional quadrants 112 and 114 defined by being bounded on the same side of object ball 40 by perpendicular band 42 of object ball 40 and bisected by perpendicular band 44 of object ball 40. The two (2) quadrants 112 and 114 preferably are provided as being white in color.

Object ball 40 also preferably includes intersections 46 and 48 between perpendicular band 42 and perpendicular band 44. Intersections 46 and 48 on object ball 40 define a section of object ball 40 defined by the intersections of perpendicular band 42 and perpendicular band 44. To enhance their contrast with the preferred white and yellow colors of object ball 40, and the preferred color green of perpendicular band 42 on object ball 40 and the preferred color black of perpendicular band 44 on object ball 40, intersections 46 and 48 on object ball 40 are preferably provided as red and rectangular and may be painted, printed, inlaid or otherwise incorporated into spherical outer surface 92 of object ball 40. One function of intersections 46 and 48 on object ball 40, the preferred "contact points" for object ball 40, is in serving to object ball 40 relative to one of intersections 36 and 38 on transparent practice cueball 30, the preferred "aiming points" for transparent practice cueball 30. It therefore will be appreciated that perpendicular bands 42 and 44 and intersections 46 and 48 on object ball 40 function synergistically in facilitating shot alignment and in providing visual information as to the physical effects of motion imparted from transparent practice cueball 30 on object ball 40. Object ball 40 preferably has a diameter of approximately 2.25 inches and a critical radius of approximately 0.5625 of an inch.

As indicated above, the purpose of the pocket billiard practice system and method of aiming in the playing of pool and billiards is for use as an aid for practicing various pool or billiard shots. When in use, transparent practice cueball 30 and object ball 40 are oriented by the shooter in a certain way for a particular shot. More specifically, referring to FIG. 2, object ball 40 is oriented such that perpendicular band 42 of object ball 40 is aligned generally vertically with respect to billiard table surface 50 and bisecting corner pocket 70, as represented by imaginary line 116. Additionally, perpendicular band 44 of object ball 40 is aligned to be parallel with billiard table surface 50 and also on the same parallel plane as perpendicular band 34 of transparent practice cueball 30. In this configuration, object ball 40 in accordance with a preferred embodiment of the present invention is considered to be properly oriented. Additionally, object ball 40 is shown as having four (4) quadrants 108, 110, 112 and 114, with two (2) quadrants 108 and 110 preferably provided as being yellow in color, and two (2) quadrants 112 and 114 preferably provided as being white in color.

The orientation of transparent practice cueball 30 in the preferred embodiment of the present invention is such that the alignment facilitates perpendicular band 34 of transparent practice cueball 30 as being parallel to billiard table surface 50. In addition, perpendicular band 32 of transparent practice cueball 30 is aligned generally vertically to billiard table surface 50, while simultaneously parallel to perpendicular band 42 of object ball 40. Imaginary line 118 running through central meridian 80 of transparent practice cueball 30 is parallel to imaginary line 116 running through central meridian 98 of object ball 40 which bisects corner pocket 70.

In the proper orientation between transparent practice cueball 30 and object ball 40 as described above, a direct line of sight, represented by imaginary line 120, for aiming may be discerned from aligning intersection 38 of transparent practice cueball 30, the preferred "aiming point" for transparent practice cueball 30, with intersection 46 of object ball 40, the preferred "contact point" for object ball 40. Thus, imaginary line 120 aligns the direct path for transparent practice cueball 30 to follow such that intersection 38 of transparent practice cueball 30, the preferred "aiming point" for transparent practice cueball 30, will impact intersection 46 of object ball 40, the preferred "contact point" for object ball 40, to propel object ball 40 along imaginary line 116. Thus, by virtue of the pocket billiard practice ball system and method of aiming in the playing of pool and pocket billiards in accordance with the preferred embodiment of the present invention disclosed herein, the player is provided with visual information as to aiming and as to the resultant effects of spin imparted by cue stick tip 82 from a stroke to transparent practice cueball 30 and the consequential effects from the impact of stroked transparent practice cueball 30 and object ball 40 and the motion of balls therefrom.

An example of how the pocket billiard practice ball system and method of aiming in the playing of pool and pocket billiards in accordance with a preferred embodiment of the present invention is used is shown in FIG. 7. With object ball 40 and transparent practice cueball 30 positioned on billiard table surface 50 as shown in FIG. 7, side pocket 58 can be made in the following manner. First, object ball 40 is positioned such that perpendicular band 42 of object ball 40 is generally vertical in relation to billiard table surface 50 and is rotated, if necessary, so central meridian 94 is congruent with imaginary line 122 drawn from the center of side pocket 58 through the center of object ball 40. Additionally, perpendicular band 44 of object ball 40, which appears from the top view to define the circumference of object ball 40, is positioned parallel and horizontal relative to billiard table surface. Intersection 46 on object ball 40 appears at an intersection between perpendicular bands 42 and 44 on object ball 40. It is now apparent to the shooter that the correct "contact point" on object ball 40 to make side pocket 58 lies at intersection 46 on object ball 40. Transparent practice cueball 30 is positioned such that perpendicular band 32 of transparent practice cueball 30 is generally vertical relative to billiard table surface 50 and rotated, if necessary, so that central meridian 76 of transparent practice cueball 30 is congruent with imaginary line 124 which is parallel in relation to imaginary line 122 which aligns object ball 40. Additionally, perpendicular band 34 of transparent practice cueball 30, which from the top view appears to define the circumference of transparent practice cueball 30, is positioned parallel and horizontal relative to billiard table surface 50. Intersection 38 on transparent practice cueball 30 appears at the intersection between perpendicular bands 32 and 34 on transparent practice cueball 30. It is now apparent to the shooter that the correct "aiming point" for transparent practice cueball 30 lies at intersection 38 on transparent practice cueball 30 which facilitates the correct reference point for a direct line of sight to be made, represented by imaginary line 126, between intersection 46 of object ball 40, the preferred "contact point" for object ball 40 and intersection 38 on transparent practice cueball 30, the preferred "aiming point" for transparent practice cueball 30, which, when impacted together, will cause object ball 40 to travel along imaginary line 122 into side pocket 58.

Figure 8:
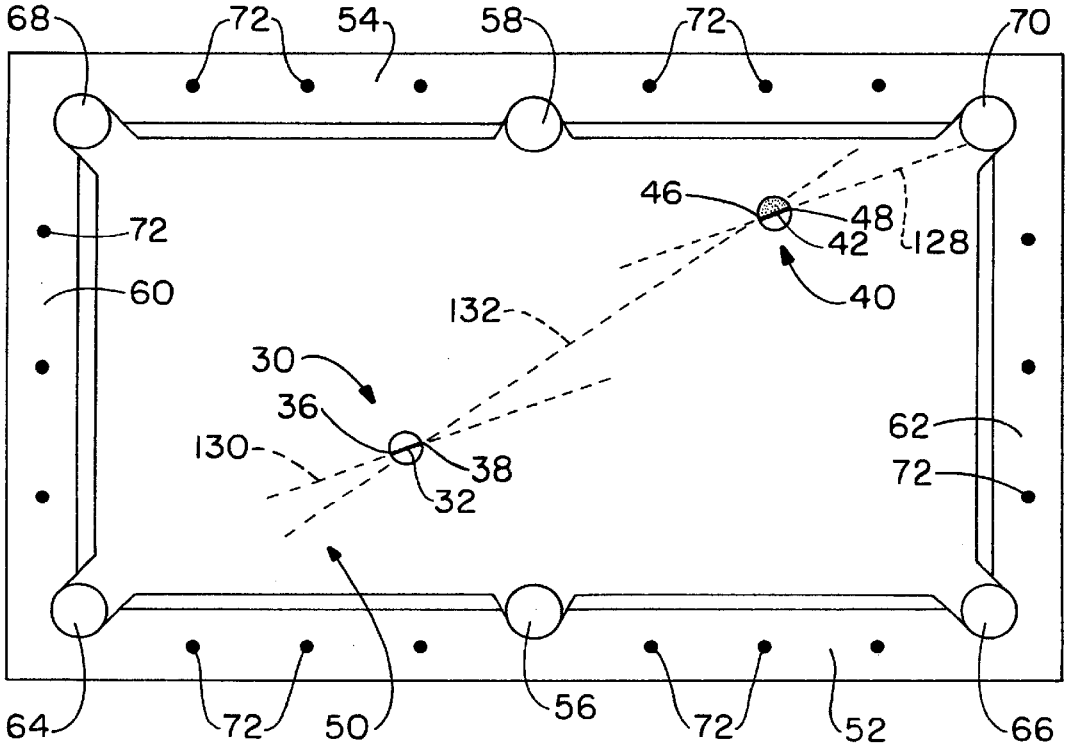
FIG. 8 is a second top view of the preferred embodiment of a pocket billiard practice ball system and method of aiming in the playing of pool and pocket billiards in accordance with the present invention as shown in FIG. 2.

Another example of how the pocket billiard practice ball system and method of aiming in the playing of pool and pocket billiards in accordance with a preferred embodiment of the present invention is used to make object ball 40 in corner pocket 70 is shown in FIG. 8. Again, object ball 40 is positioned such that perpendicular band 42 of object ball 40 is generally vertical relative to billiard table surface 50 and is rotated, if necessary, so central meridian 94 is congruent with imaginary line 128 drawn from the center of corner pocket 70 through the center of object ball 40. Additionally, perpendicular band 44 of object ball 40, which appears from the top view to define the circumference of object ball 40, is positioned parallel and horizontal relative to billiard table surface 50. Intersection 46 on object ball 40 appears at an intersection between perpendicular bands 42 and 44 on object ball 40. It is now apparent to the shooter that the correct "contact point" on object ball 40 to make corner pocket 70 lies at intersection 46 on object ball 40. Transparent practice cueball 30 is positioned such that perpendicular band 32 of transparent practice cueball 30 is generally vertical relative to billiard table surface 50 and rotated, if necessary, so that central meridian 76 of transparent practice cueball 30 is congruent with imaginary line 130 which is parallel in relation to imaginary line 128 which aligns object ball 40. Additionally, perpendicular band 34 of transparent practice cueball 30, which from the top view appears to define the circumference of transparent practice cueball. 30, is positioned parallel and horizontal relative to billiard table surface 50. Intersection 38 on transparent practice cueball 30 appears at the intersection between perpendicular bands 32 and 34 on transparent practice cueball 30. It is now apparent to the shooter that the correct "aiming point" for transparent practice cueball 30 lies at intersection 38 on transparent practice cueball 30 which facilitates the correct reference point for a direct line of sight to be made, represented by imaginary line 132, between intersection 46 of object ball 40, the preferred "contact point" for object ball 40 and intersection 38 on transparent practice cueball 30, the preferred "aiming point" for transparent practice cueball 30, which, when impacted together, will cause object ball 40 to travel along imaginary line 128 into corner pocket 70.

Figure 9:
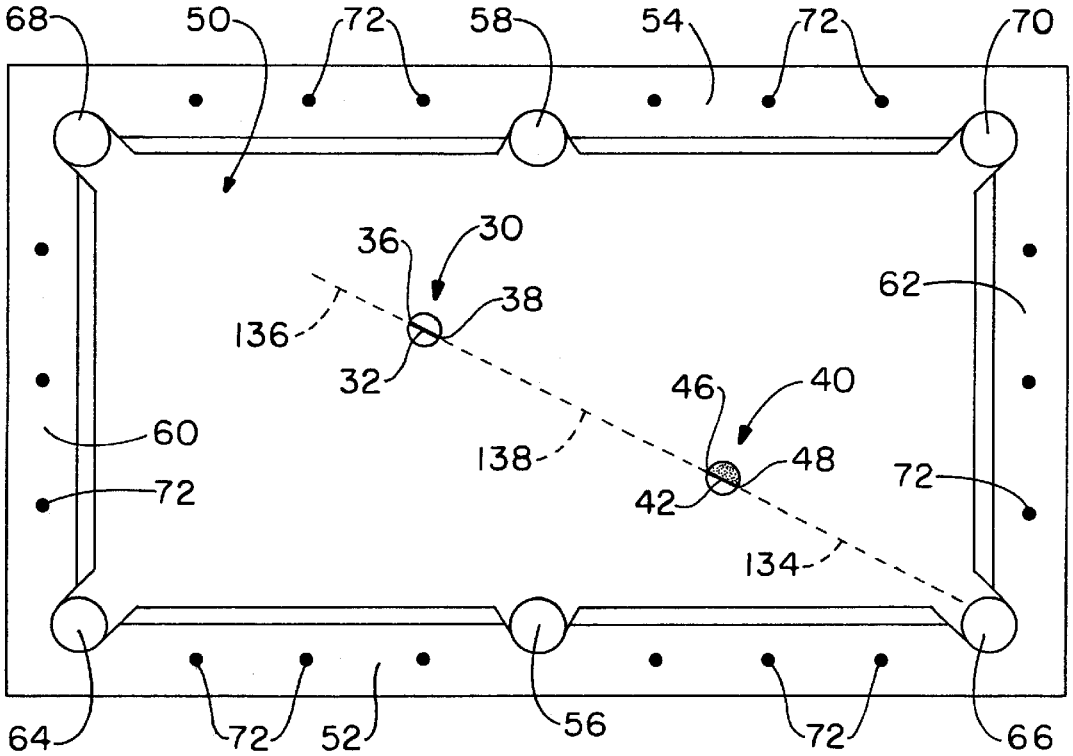
FIG. 9 is a third top view of the preferred embodiment of a pocket billiard practice ball system and method of aiming in the playing of pool and pocket billiards in accordance with the present invention as shown in FIG. 2.

Yet another example of how the pocket billiard practice ball system and method of aiming in the playing of pool and pocket billiards in accordance with a preferred embodiment of the present invention is used to make a straight shot between transparent practice cueball 30 and object ball 40 into corner pocket 66 is shown in FIG. 9. Here imaginary line 134 running through central meridian 94 of object ball 40 and imaginary line 136 running through central meridian 76 of transparent practice cueball 30 are congruent with each other, and imaginary line 134 bisects corner pocket 66. Again, object ball 40 is positioned such that perpendicular band 42 of object ball 40 is generally vertical relative to billiard table surface 50 and is rotated, if necessary, so central meridian 94 is congruent with imaginary line 134 drawn from the center of corner pocket 66 through the center of object ball 40. Additionally, perpendicular band 44 of object ball 40, which appears from the top view to define the circumference of object ball 40, is positioned parallel and horizontal relative to billiard table surface 50. Intersection 46 on object ball 40 appears at an intersection between perpendicular bands 42 and 44 on object ball 40. It is now apparent to the shooter that the correct "contact point" on object ball 40 to make corner pocket 66 lies at intersection 46 on object ball 40. Transparent practice cueball 30 is positioned such that perpendicular band 32 of transparent practice cueball 30 is generally vertical relative to billiard table surface 50 and rotated, if necessary, so central meridian 80 of transparent practice cueball 30 is congruent with imaginary line 136 which is parallel in relation to imaginary line 134 which aligns object ball 40. Additionally, perpendicular band 34 of transparent practice cueball 30, which from the top view appears to define the circumference of transparent practice cueball 30, is positioned parallel and horizontal relative to billiard table surface 50. Intersection 38 on transparent practice cueball 30 appears at the intersection between perpendicular bands 32 and 34 on transparent practice cueball 30. It is now apparent to the shooter that the correct "aiming point" for transparent practice cueball 30 lies at intersection 38 on transparent practice cueball 30 which facilitates the correct reference point for a direct line of sight to be made, represented by imaginary line 138, between intersection 46 of object ball 40, the preferred "contact paint" for object ball 40 and intersection 38 on transparent practice cueball 30, the preferred "aiming point" for transparent practice cueball 30, which, when impacted together, will cause object ball 40 to travel along imaginary line 134 into corner pocket 66.

Accordingly, although the present invention has been described above in detail, the same is by way of illustration and example only and is not to be taken as a limitation on the present invention. For example, it is apparent to those having a level of ordinary skill in the relevant art that other variations and modifications in a pocket billiard practice ball system and method of aiming in the playing of pool and pocket billiards in accordance with the present invention, as described and shown herein, could be readily made using the teachings of the present invention. It is anticipated that certain embodiments may be made in other specific forms without departing from the spirit, essential characteristics or scope herein involved of the present invention. The preferred embodiment of the present invention disclosed herein is considered in all respects as illustrative and not restrictive, the scope of the invention being indicated by the appended claims rather than by the foregoing description and all changes which come within the meaning and range of the equivalency of the claims are therefore intended to be embraced therein. Accordingly, the scope and content of the present invention are to be defined only by the terms of the appended claims.

What is claimed is:

1. A combination of a cueball and an object ball for use in playing pool or billiards, said combination of a cueball and an object ball comprising:

a cueball having a generally spherical outer surface with a first band extending around the circumference of said cueball, a second band extending around the circumference of said cueball, said second band being substantially perpendicular to said first band, a first intersection between said first band and said second band and a second intersection between said first band and said second band, said first intersection and said second intersection are capable of being aligned to provide an "aiming line" for said cueball; and an object ball having a generally spherical outer surface having a first band extending around the circumference of said object ball, a second band extending around the circumference of said object ball, said second band being substantially perpendicular to said first band, a first intersection between said first band and said second band and a second intersection between said first band and said second band, said first intersection and said second intersection are capable of being aligned to provide a "contact point" for said object ball.

2. The cue ball in accordance with claim 1, wherein said cue ball is substantially transparent.

3. The cue ball in accordance with claim 1, wherein said cue ball is substantially transparent, said first band is a different color from said cue ball and said second band is a different color from said cue ball and from said first band.

4. The cueball in accordance with claim 3, wherein said first band is green and said second band is black.

5. The cueball in accordance with claim 4, wherein said first intersection is red and said second intersection is red.

6. The cueball in accordance with claim 5, wherein said cueball is approximately 2.25 inches in diameter.

7. The cueball in accordance with claim 5, wherein said first band is approximately 11 millimeters wide and said second band is approximately 11 millimeters wide.

8. The cue ball in accordance with claim 1, wherein said cue ball is approximately 2.25 inches in diameter.

9. The object ball in accordance with claim 1, wherein said object ball is opaque.

10. The object ball in accordance with claim 1, wherein said object ball is opaque, said first band is a different color from said object ball and said second band is a different color from said object ball and from said first band.

11. The object ball in accordance with claim 10, wherein said first band and said second band define four (4) quadrants on said object ball and two (2) of said four (4) quadrants are of a different color than the other two (2) of said four (4) quadrants.

12. The object ball in accordance with claim 11, wherein said two (2) said four (4) quadrants are white in color and said other two (2) of said four (4) quadrants are yellow in color.

13. The object ball in accordance with claim 10, wherein said first intersection is green and said second band is black.

14. The object ball in accordance with claim 13, wherein said first intersection is red and said second intersection is red.

15. The object ball in accordance with claim 14, wherein said object ball is approximately 2.25 inches in diameter.

16. The object ball in accordance with claim 15, wherein said first band is approximately 11 millimeters wide and said second band is approximately 11 millimeters wide.

17. The object ball in accordance with claim 1, wherein said object ball is approximately 2.25 inches in diameter.

18. A method for aligning, aiming and shooting in the playing of pool or billiards on a billiard table having a billiard table surface and at least one pocket, said method comprising the steps of:

providing an object ball having a generally spherical outer surface having a first band extending around the circumference of said object ball, a second band extending around the circumference of said object ball, said second band being substantially perpendicular to said first band, a first intersection between said first band and said second band and a second intersection between said first band and said second band;

orienting said object ball with said first band positioned substantially vertical relative to the billiard table surface and in line with the at least one pocket on the billiard table and with said second band positioned substantially parallel to the billiard table surface such that one of said first intersection and said second intersection on said object ball is positioned as a "contact point" for said object ball;

providing a cueball having a generally spherical outer surface with a first band extending around the circumference of said cueball, a second band extending around the circumference of said cueball, said second band being substantially perpendicular to said first band, a first intersection between said first band and said second band and a second intersection between said first band and said second band being aligned to provide an "aiming line" for said cueball; and orienting said cueball with said first band positioned substantially vertical relative to the billiard table surface and parallel with said first band on said object ball and with said second band positioned substantially to the billiard table surface.

19. The method in accordance with claim 18, further including the step of propelling said cueball along said "aiming line" between intersection of said first band and said second band on said cueball to contact said "contact point" on said object ball following the step of orienting said cueball with said first band positioned substantially vertical relative to the billiard table surface and parallel with said first band on said object ball and with said second band positioned substantially parallel to the billiard table surface.

* * * * *